US006573915B1

(12) United States Patent
Sivan et al.

(10) Patent No.: US 6,573,915 B1
(45) Date of Patent: Jun. 3, 2003

(54) EFFICIENT CAPTURE OF COMPUTER SCREENS

(75) Inventors: Zohar Sivan, Zichron Yaakov (IL); Konstantin Y. Kupeev, Haifa (IL)

(73) Assignee: International Business Machines Corporation, Armonk, NY (US)

( * ) Notice: Subject to any disclaimer, the term of this patent is extended or adjusted under 35 U.S.C. 154(b) by 0 days.

(21) Appl. No.: 09/456,343

(22) Filed: Dec. 8, 1999

(51) Int. Cl.[7] ..... G09G 5/00

(52) U.S. Cl. ..... 345/781; 345/802; 345/803; 345/804; 345/788

(58) Field of Search ..... 345/781, 802, 345/803, 804, 788, 798, 790, 794, 800, 806

(56) References Cited

U.S. PATENT DOCUMENTS

| | | | | | |
|---|---|---|---|---|---|
| 5,438,661 | A | * | 8/1995 | Ogawa | 345/157 |
| 5,577,186 | A | | 11/1996 | Mann, II et al. | 395/806 |
| 5,600,346 | A | * | 2/1997 | Kamata et al. | 345/120 |
| 5,745,738 | A | | 4/1998 | Ricard | 395/500 |
| 5,844,613 | A | * | 12/1998 | Chaddha | 348/416 |
| 5,850,221 | A | * | 12/1998 | Macrae et al. | 345/835 |
| 5,880,733 | A | * | 3/1999 | Horvitz et al. | 345/848 |
| 6,016,145 | A | * | 1/2000 | Horvitz et al. | 345/788 |
| 6,272,493 | B1 | * | 8/2001 | Pasquali | 707/10 |

OTHER PUBLICATIONS

Product details, Lotus ScreenCam; http://www.lotus.com/products/screencam.
Product details, Hyperionics Hypercam; http://www.hyperionics.com.
Product details, TechSmith SnagIt/32; http://www.snagit-.com/products/snagit/index.
Product details, OPTX International Screenwatch; http://www.screenwatch.com.
Product details, Symantec PC Anywhere; http://www.symantec.com/region/can/eng/product/pcanywhere.
Product details, LapLink.com LapLink; http://www.laplink-.com/products/llpro.
P. Boyle, "Friendly Takeovers", PC Magazine, Aug. 1996.
J. Les et al., "Explanation and Guidance in a Learning Environment: Recording and Using Sam Multimedia Demos", ASCILITE '97, Dec. 1997.

* cited by examiner

*Primary Examiner*—John Cabeca
*Assistant Examiner*—Cuong T. Thai
(74) *Attorney, Agent, or Firm*—Darby & Darby

(57) ABSTRACT

A method for capture of computer screens in a sequence of frames. A first set of one or more windows appearing in a first frame in the sequence is identified, each window in the set having respective first-frame window characteristics and window contents. A description of the first set of windows is encoded, indicative of the appearance of the computer screen in the first frame. In a second frame in the sequence, a second set of one or more windows is identified, having respective second-frame window characteristics and window contents, the second set including one or more windows corresponding respectively to one or more of the windows in the first set. One or more transformations are determined, which are applied to the first-frame window characteristics of the windows in the first set to generate the second-frame window characteristics of the corresponding windows in the second set. A description of the second set of windows is encoded, including the determined transformations, for use in reconstructing the computer screen as it appeared in the second frame.

36 Claims, 5 Drawing Sheets

EFFICIENT CAPTURE OF COMPUTER SCREENS

FIELD OF THE INVENTION

The present invention relates generally to computer software, and specifically to programs enabling capture, storage and communication of the contents of computer displays.

BACKGROUND OF THE INVENTION

There are a variety of computer screen capture tools known in the art. These tools enable the contents and appearance of a computer screen to be captured, or recorded, more or less in real-time. Generally, a sequence of screens is captured and is then stored to disk and/or transferred to another computer. Screen capture tools of this sort are useful, for example, in educational applications and in training and promotional demonstrations. Screen capture is also used by computer remote control tools.

Screen capture products for education, training and promotion include Lotus ScreenCam (http://www.lotus.com/screencam), Hyperionics HyperCam (http://www.hyperionics. com) and TechSmith SnagIt/32 (http://www.techsmith.com) These products enable a user to record the contents of a computer screen to a file, while the computer is carrying out another program, and then to reproduce the recorded screen content from the file. They evidently work by encoding a bitmap image of the entire contents of the screen. Multiple screens in sequence may be recorded by encoding the differences between successive screens. This approach usually generates large amounts of processed data and very large output files. As a result, users may be limited to working at very slow refresh rates, on the order of one or a few frames per second, if they wish to record a full, active computer screen. Transferring the output files over a low-bandwidth computer network may be even slower. The alternative is to compromise on the content of the recording, typically by reducing the color resolution, by recording only a portion of the screen, or by simplifying the screen contents, by reducing the number of windows that are open on screen, for example.

OPTX International ScreenWatch (http://www.screenwatch.com) uses an alternative approach of capturing data sent to the computer's display driver, in this case a proprietary driver developed for this purpose by OPTX. The display driver runs on a Microsoft Windows NT computer, which conveys the data to a separate client computer for recording. The data are stored in a proprietary format, which can subsequently be played back using a dedicated player program. The alternative approach employed by ScreenWatch enables faster, more efficient screen capture, but is limited to the complex, proprietary operating environment for which it was designed.

Computer remote control tools include Symantec PCAnywhere (http://www.symantec.com/region/can/eng/ product/pcanywhere) and LapLink.com LapLink (http://www.travsoft.com/products/llpro). These products enable a remote user to control a host computer and observe the screen contents of the host. They are not capable of keeping up with large or rapid changes on the host computer screen, even at high transmission bit rates between the host and remote computers.

SUMMARY OF THE INVENTION

It is an object of the present invention to provide improved tools for computer screen capture and playback.

It is a further object of some aspects of the present invention to reduce the volume of data required to capture complex computer screen contents.

It is still a further object of some aspects of the present invention to increase the frame rate at which computer screen contents can be captured.

It is yet another object of some aspects of the present invention to provide tools for computer screen capture that are applicable to a wide range of platforms and can be played back by a platform-independent player.

In preferred embodiments of the present invention, a computer screen capture tool treats windows on the computer display as objects, and records changes in the characteristics of these objects and relations among them from frame to frame. Preferably, a group of typical transformations of the windows is defined, and these typical transformations are encoded and recorded separately from other changes in the window contents. Generally speaking, the typical transformations are defined by an operating system of the computer, and they are therefore common to windows running different applications and can be encoded very compactly for all of the windows on the screen. In this way, the amount of bitmap data that must be recorded is substantially reduced relative to screen capture tools known in the art.

Displays with multiple active windows can thus be recorded and transmitted in real time, with high temporal resolution (i.e., high frame refresh rates), as well as full color definition and detail, while the computer is carrying out application tasks. No special resources are needed, in contrast to products known in the art such as the above-mentioned ScreenWatch. Different encoding schemes can be applied to the contents of different windows, depending on the type of contents (for example, video as opposed to text). In some preferred embodiments, movements of other on-screen objects, such as a mouse-driven cursor and other icons, are also encoded using typical transformations.

To play back the recorded screens, the windows and other objects are reconstructed in each successive frame by applying the encoded typical transformations to the windows and objects in the preceding frame. The window contents are then reconstructed inside the windows. Preferably, a screen player program for reconstructing the recorded screens is independent of the operating system of the recording computer. Most preferably, the screen player is provided in a platform-independent form, for example, in the Java language.

Preferred embodiments of the present invention are useful in a range of applications, including demonstrations and presentations, education and remote control, as described in the Background of the Invention.

There is therefore provided, in accordance with a preferred embodiment of the present invention, a method for capture of computer screens in a sequence of frames, including:

identifying a first set of one or more windows appearing in a first frame in the sequence, each window in the set having respective first-frame window characteristics and window contents;

encoding a description of the first set of windows indicative of the appearance of the computer screen in the first frame;

identifying in a second frame in the sequence a second set of one or more windows having respective second-frame window characteristics and window contents, the second set including one or more windows corresponding respectively to one or more of the windows in the first set;

determining one or more transformations applied to the first-frame window characteristics of the windows in the first set to generate the second-frame window characteristics of the corresponding windows in the second set; and encoding a description of the second set of windows including the determined transformations, for use in reconstructing the computer screen as it appeared in the second frame.

Preferably, identifying the first set of windows includes identifying windows generated in accordance with an operating system of the computer, which associates each window with a respective function of the computer, such that the contents of the windows are determined by the respective functions. Most preferably, the respective functions include applications running under the operating system. Further preferably, determining the transformations includes defining transformations applied by the operating system, and which are applicable to different windows associated with different functions, generally irrespectively of the functions. Preferably, identifying the second set of windows includes querying the operating system regarding the characteristics of the windows. Additionally or alternatively, identifying the second set of windows includes intercepting events generated by the operating system.

In a preferred embodiment, identifying the first set of windows includes processing an image of the screen to identify the windows.

Preferably, determining the transformations includes defining a set of typical transformations, which are applicable to alter the window characteristics of the one or more windows, generally irrespectively of the contents of the windows. In preferred embodiments, the typical transformations are selected from a group of transformations including moving and resizing a window; minimizing, restoring and maximizing the size of a window; changing a Z-order of the windows, according to which two or more of the windows are overlaid one upon another on the screen; and scrolling and panning the window contents.

Preferably, encoding the description of the first set of windows includes encoding the first-frame window characteristics and the respective contents of the windows in the first set, and encoding the description of the second set of windows includes encoding the determined transformations and encoding changes in the contents of the windows in the second set with respect to the contents of the corresponding windows in the first set. In a preferred embodiment, encoding the changes in the contents of the windows includes applying different encoding schemes to the contents of different ones of the windows, wherein applying the different encoding schemes includes applying a video compression scheme to the contents of at least one of the windows, and embedding resultant compressed video data in the encoded description of the windows. Additionally or alternatively, applying the different encoding schemes includes applying different levels of encoding resolution to different ones of the windows in the second set.

Preferably, identifying the first and second sets of windows includes identifying windows associated with respective functions of the computer, wherein the identified windows include one or more user interface windows generated inside other identified windows for the purpose of controlling the functions associated therewith.

In a preferred embodiment, the method includes identifying first and second sets of one or more icons in the first and second frames, respectively, and determining transformations applied to the icons in the first frame to generate the icons in the second frame, to be encoded along with the description of the second set of windows. Preferably, the first and second sets of icons include a cursor.

In another preferred embodiment, encoding the first and second descriptions includes transferring the encoded descriptions over a communication link to a recipient computer. Most preferably, encoding the descriptions includes encoding the descriptions in a platform-independent format.

Alternatively or additionally, encoding the first and second descriptions includes storing the encoded descriptions in a memory.

There is also provided, in accordance with a preferred embodiment of the present invention, a method for reconstructing captured computer screens, including:

receiving an encoded description of a first set of one or more windows, having first-frame characteristics and window contents, which appeared on the computer screen in a first captured frame;

receiving an encoded description of a second set of one or more windows, having second-frame characteristics and window contents, which appeared on the computer screen in a second captured frame, subsequent to the first frame, the description of the second set of windows including a description of one or more transformations applied to the first-frame characteristics of at least one of the windows in the first set to derive the second-frame characteristics of a corresponding window in the second set; and reconstructing the second captured frame responsive to the encoded descriptions of the first and second sets of windows.

Preferably, reconstructing the second captured frame includes decoding the encoded description of the first set of windows to determine the first-frame characteristics thereof, and applying the one or more transformations described in the description of the second set of windows to transform the first-frame characteristics into the second-frame characteristics of the at least one corresponding window. Most preferably, the encoded description of the second set of windows further includes encoded changes in the contents of the windows in the second set with respect to the contents of the at least one corresponding window in the first set, and reconstructing the second captured frame includes reconstructing the contents of the windows in the second set responsive to the encoded changes. In a preferred embodiment, the encoded description of the second set of windows includes compressed video data in a standard media format, and reconstructing the second captured frame includes invoking a standard media player to reconstruct video images in one of the windows.

Preferably, reconstructing the second captured frame includes reconstructing the first and second sets of windows substantially independently of an operating system under which the windows were generated, wherein reconstructing the first and second sets of windows includes operating a platform-independent screen player.

There is additionally provided, in accordance with a preferred embodiment of the present invention, apparatus for capture of computer screens in a sequence of frames, including:

a display; and a processor, which is adapted to identify a first set of one or more windows appearing on the display in a first frame in the sequence, each window in the set having respective first-frame window characteristics and window contents, and to encode a description of the first set of windows, indicative of the appearance of the computer screen in the first frame, and to identify, in a second frame in the sequence a second set of one or more windows appearing on the display, having respective second-frame window characteristics and window contents, the second set including one or more windows corresponding respectively to one or more of the windows in the first set, and to determine one or more transformations applied to the first-frame window characteristics of the windows in the first set to generate the second-frame window characteristics of the corresponding windows in the second set, and to encode a description of the second set of windows including the determined transformations, for use in reconstructing the computer screen as it appeared in the second frame.

In a preferred embodiment, the processor is adapted to be coupled via a communication link to transfer the encoded descriptions to a recipient computer, which reconstructs the second frame responsive to the encoded descriptions of the first and second sets of windows.

In another preferred embodiment, the processor includes a memory adapted to store the encoded first and second descriptions.

There is further provided, in accordance with a preferred embodiment of the present invention, apparatus for reconstructing captured computer screens, including:

a processor, which is adapted to receive an encoded description of a first set of one or more windows, having first-frame characteristics and window contents, which appeared on the computer screen in a first captured frame, and to receive an encoded description of a second set of one or more windows, having second-frame characteristics and window contents, which appeared on the computer screen in a second captured frame, subsequent to the first frame, the description of the second set of windows including a description of one or more transformations applied to the first-frame characteristics of at least one of the windows in the first set to derive the second-frame characteristics of a corresponding window in the second set, and to reconstruct the first and second captured frames responsive to the encoded descriptions of the first and second sets of windows; and a display, which is adapted to be driven by the processor to display the reconstructed first and second frames.

There is moreover provided, in accordance with a preferred embodiment of the present invention, a computer software product for capture of computer screens in a sequence of frames, the product including computer-readable media in which program instructions are stored, which instructions, when read by a computer, cause the computer:

to identify a first set of one or more windows appearing in a first frame in the sequence, each window in the set having respective first-frame window characteristics and window contents and to encode a description of the first set of windows, indicative of the appearance of the computer screen in the first frame, and to identify in a second frame in the sequence a second set of one or more windows having respective second-frame window characteristics and window contents, the second set including one or more windows corresponding respectively to one or more of the windows in the first set and to determine one or more transformations applied to the first-frame window characteristics of the windows in the first set to generate the second-frame window characteristics of the corresponding windows in the second set, and to encode a description of the second set of windows including the determined transformations, for use in reconstructing the computer screen as it appeared in the second frame.

There is furthermore provided, in accordance with a preferred embodiment of the present invention, a computer software product for reconstructing captured computer screens, the product including computer-readable media to be read by a computer that receives an encoded description of a first set of one or more windows belonging to a first captured frame, the windows having first-frame characteristics and window contents, and an encoded description of a second set of one or more windows belonging to a second captured frame, subsequent to the first frame, the windows having second-frame characteristics and window contents, the description of the second set of windows including a description of one or more transformations applied to the first-frame characteristics of at least one of the windows in the first set to derive the second-frame characteristics of a corresponding window in the second set, wherein program instructions are stored in the computer-readable media, which instructions, when read by the computer, cause the computer to reconstruct the second captured frame responsive to the encoded descriptions of the first and second sets of windows.

The present invention will be more fully understood from the following detailed description of the preferred embodiments thereof, taken together with the drawings in which:

DETAILED DESCRIPTION OF PREFERRED EMBODIMENTS

Figure 1:
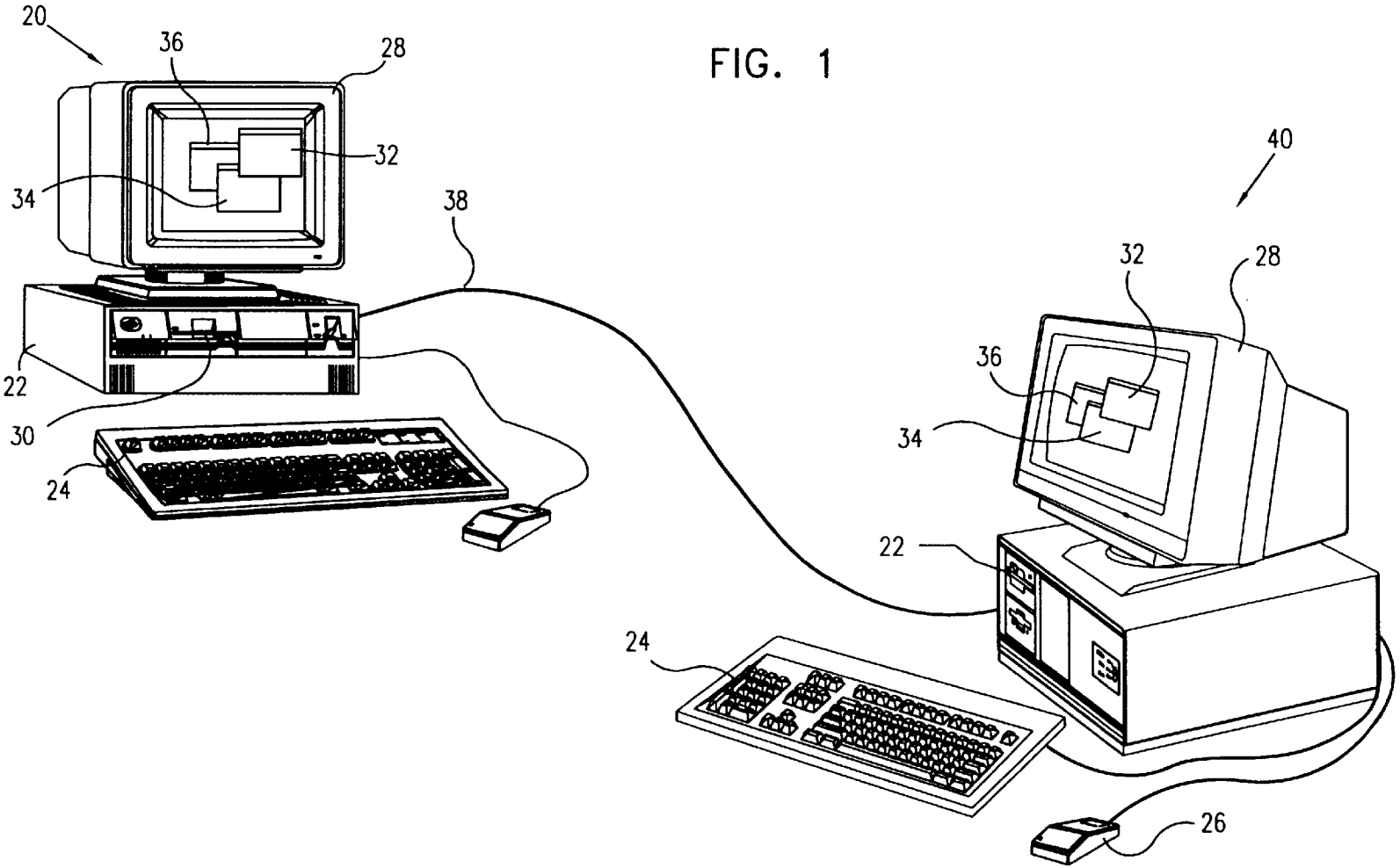
FIG. 1 is a schematic, pictorial illustration showing apparatus for capturing and replaying computer screens, in accordance with a preferred embodiment of the present invention.

FIG. 1 is a schematic, pictorial illustration showing screen capture apparatus 20 for capturing computer screens and playback apparatus 40 for reconstructing and playing back the captured screens, in accordance with a preferred embodiment of the present invention. Preferably, both apparatus 20 and apparatus 40 comprise computers, typically personal computers, each comprising a processor 22, a keyboard 24, a pointing device, such as a mouse 26, and a display 28. Capture apparatus 20 runs operating system software, such as Microsoft Windows or other similar operating systems known in the art, which generates a plurality of windows 32, 34 36 on display 28. Typically, each window displays data and allows user interaction with a different, respective software application running on apparatus 20, or with different instances of a given application.

As described in detail hereinbelow, capture apparatus 20 runs a screen capture program, which encodes the images shown on display 28 for subsequent playback. Preferably, encoded data corresponding to the display images are conveyed over a communication link 38, such as a computer network, for playback on apparatus 40. Alternatively or additionally, the encoded data are recorded in a memory of apparatus 20, typically on a hard disk 30. The data recorded on disk 30 may also be played back on the same apparatus 20 on which the screens were captured. The programs required by processors 22 for capturing and reconstructing the screen images may be downloaded to apparatus 20 and/or 40 in electronic form via a network, for example, or they may alternatively be supplied on tangible media, such as CD-ROM.

Figure 2:
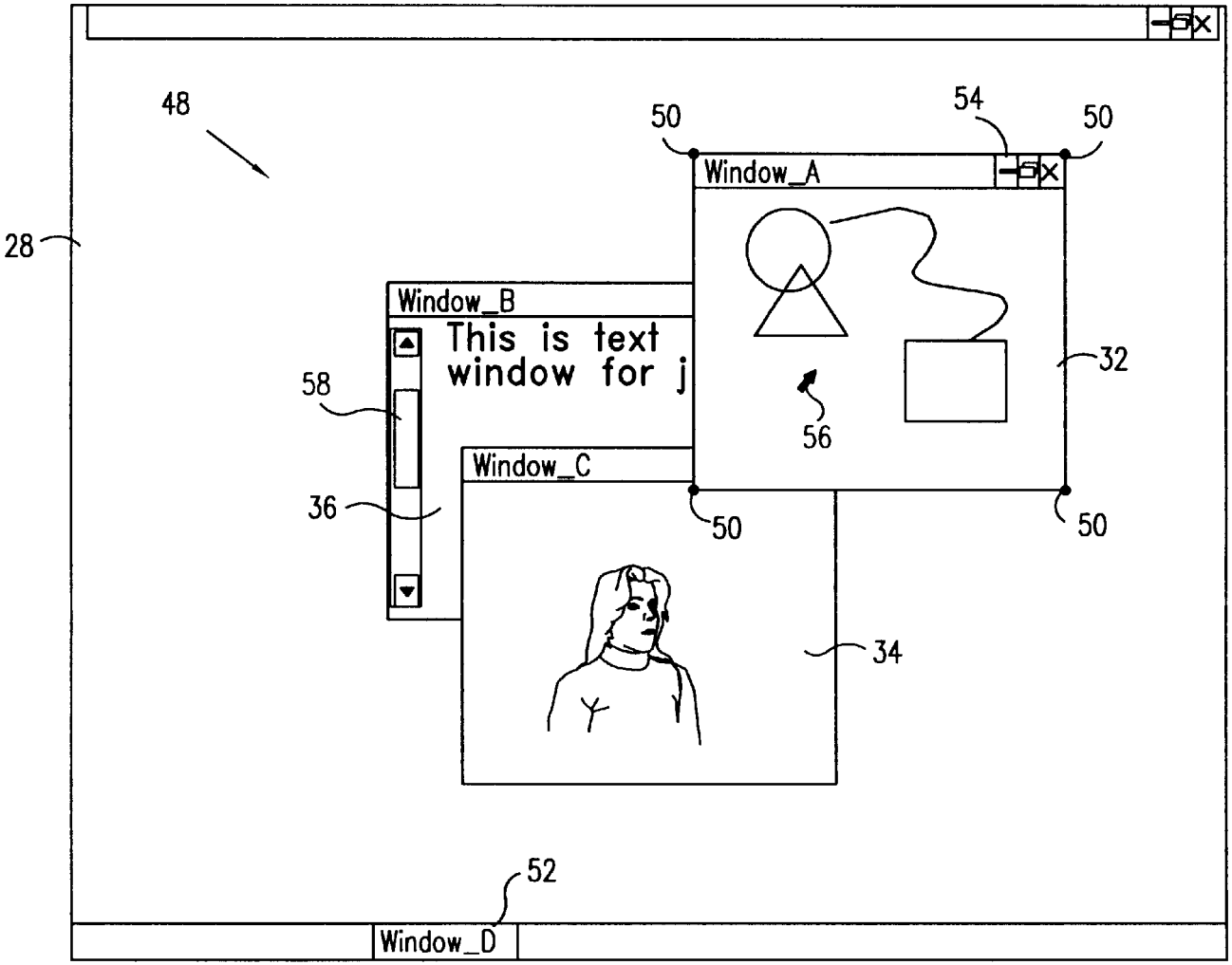
FIG. 2 is a schematic illustration of a computer screen captured by the apparatus of FIG. 1, in accordance with a preferred embodiment of the present invention.

FIG. 2 is a schematic illustration showing details of display 28 as captured by apparatus 20, in accordance with a preferred embodiment of the present invention. The display shows a family 48 of windows, including open windows 32, 34 and 36 and another window 52 which is minimized and displayed only as an icon, although the application associated with the window may continue to run. Transformations such as minimization, maximization, restoration and closing of each of the windows are typically effected using controls 54, as are known in the art. Each of the windows can also be moved and resized, generally by using mouse 26 to manipulate a cursor 56 on screen. At any point that a window is open on display 28, its size and position are defined by its corners 50, wherein assuming the window to be rectangular, the coordinates of two of the corners are sufficient to fully define the size and position.

The windows in family 48 are also characterized by a Z-order, which determines their respective priorities when two or more windows overlap. In the case shown in the figure, the order is window 32, followed by window 34, followed by window 36, although of course, the order commonly changes from time to time.

As mentioned above, each of the windows in family 48 is typically (although not necessarily) associated with a different application. By way of example, window 32 is running a graphic application, window 34 is displaying a real-time video image, and window 36 is running a text application. Window 36 includes a scroll bar 58, which enables a user to scroll through the document shown in the window. The contents of each of the windows are updated regularly by the applications associated therewith. The applications may also include other effects, particularly sound, which is typically played in conjunction with the display in the respective window.

Separate and apart from application-specific changes in the window contents, there are common transformations that can be applied to any of the windows or at least to a range of different applications. Such transformations are generally implemented in the operating system, although some of them may be generated by application or utility programs. A list of such transformations, referred to herein as typical transformations, is presented by way of example, but not limitation, in Table I below.

TABLE I

| TYPICAL TRANSFORMATIONS |
|---|
| Move window |
| Resize window |
| Minimize (iconize) window |
| Maximize window |
| Restore window |
| Change Z-order of windows |
| Scroll window contents |
| Pan window contents |
| Change color palette |

Other transformations may also be classified as typical, for example, inversion of the contents of a window. These and other transformations can also be applied to non-rectangular windows or overlays, although the sizes and positions of such windows may need to be represented by more than just the corner positions used for standard rectangular windows. Movements of cursor 56 and other on-screen icons can likewise be classified as "move" operations, similar to moving of windows.

Figure 3:
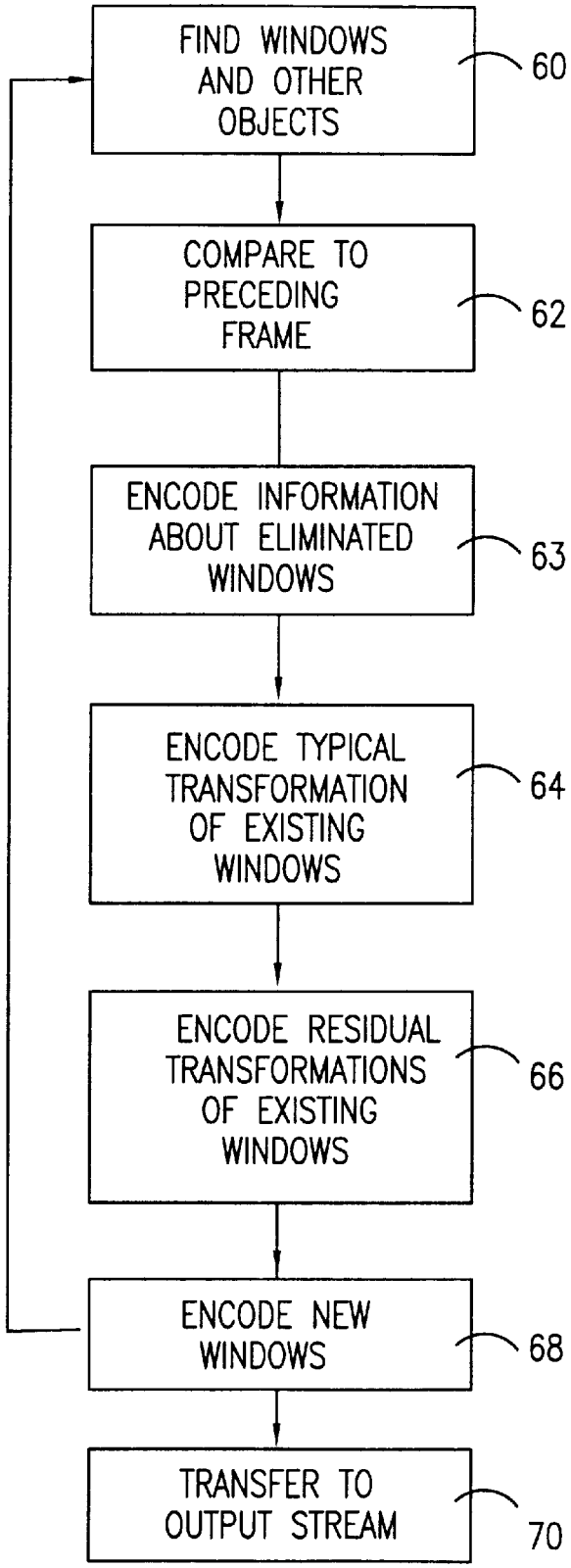
FIG. 3 is a flow chart, which schematically illustrates a method for capturing computer screens, in accordance with a preferred embodiment of the present invention.

FIG. 3 is a flow chart that schematically illustrates a method for capturing and encoding computer screens using typical transformations, in accordance with a preferred embodiment of the present invention. The method is described with reference to window family 48, shown in FIG. 2, on a personal computer running a Microsoft Windows operating system, but it will be understood that the principles of this method are equally applicable to other types of windows and other operating systems and applications.

For each screen to be captured, at each capture time, or frame time $t_i$, apparatus 20 identifies the windows and other objects shown on display 28, at a find window step 60. In the example of FIG. 2, these windows and objects would include windows 32, 34, 36 and 52 (which is "iconized"), as well as cursor 56. Optionally, other icons and window-like objects are also captured, for example, menu windows and sub-windows that are opened within the client areas of the application windows. The characteristics of the windows and objects, including their location, size and Z-order, are recorded, so as to define window family 48 at time $t_i$, referred to herein as $FW(t_i)$ Formally, $FW(t_i)$ preferably contains the group of windows $W_1, W_2, \ldots, W_{N(i)}$, each window, dependent on the time instance $t_i$ characterized by the following parameters:

A set of corners 50.

A bit value b(0,1) indicating whether the window is iconized in the current frame.

A Z-order position. In this regard, $FW(t_i)$ may be regarded as a directed graph (digraph), wherein there is a vertex in the graph corresponding to each window $W_i$, and directed edges of the graph connecting the vertices, dependent on the Z-order relation between the respective windows.

The window content. Typically the content is represented as a bitmap, but it may also be captured and stored in other, application-specific formats, as described further hereinbelow.

Preferably, $FW(t_i)$ is constructed by querying the operating system and, optionally, the application software running on processor 22 of apparatus 20 as to the window parameters. In a preferred embodiment of the present invention, the queries are made using application program interface (API) commands available for the Windows operating system, including EnumWindows, GetWindowRect, GetDeviceCaps, GetWindowDC, ReleaseDC, IsIconic, GetTopWindow, and IsWindowVisible. Alternatively, other methods may be used to identify the windows and extract the required parameters. For example, a window procedure subclassing technique may be used to intercept the messages posted or sent to the windows, as described in the WIN32 Programmer's Reference (Microsoft Press, 1993), which is incorporated herein by reference. Alternatively, a pixel image of display 28 may be processed, using image processing methods known in the art, in order to identify rectangular shapes corresponding to the windows on screen.

It should be understood that while the description herein of the method illustrated in FIG. 3 makes reference to construction of the family of windows $FW(t_i)$ in each frame, it is generally not necessary to construct $FW(t_i)$ ab initio except in the initial frame at $t_0$. Rather, at each time $t_i$ (except $t_0$), resources needed for constructing $FW(t_i)$ are obtained from the preceding window family $FW(t_{i-1})$ Each frame in the sequence of screen images to be captured (except for the first frame, of course, at time $t_0$), is compared to the preceding frame, in a compare step 62. This step classifies the windows in family 48, $FW(t_i)$ into three groups:

1. Windows that were also present in the preceding frame $FW(t_{i-1})$.
2. Windows that were in the preceding frame but are absent from the current frame.
3. Windows that appear in the current frame, but were absent in the preceding frame.

In an eliminated windows encoding step 63, information regarding the windows in group 2 (such as the indices of the graph vertices corresponding to these windows in $FW(t_{i-1})$) is encoded. By eliminating the windows in group 2 from the set of windows in $FW(t_{i-1})$ (group 1), an intermediate family FW1 is defined containing the windows that appear in both the current frame and the preceding frame, with their parameters at time $t_{i-1}$. Changes to the windows of FW1 can be characterized by typical transformations, as described further hereinbelow. Treatment of the windows in group 3 is described further hereinbelow.

The windows in the intermediate family FW1 and their parameters are compared to their counterparts in $FW(t_i)$ at a typical transformation encoding step 64 and a residual transformation encoding step 66. In step 64, those changes in the windows that are capable of definition as typical transformations, such as those listed in Table I, are identified and encoded. For example, in a successive frame to that shown on display 28 in FIG. 2, window 32 might be shifted, window 34 might be closed or iconized, and window 36 might be scrolled. In this case, the shift can be encoded symbolically as SHIFT(A,X,Y), wherein A identifies the window, and X and Y are the displacement coordinates in pixels. Closing or iconizing of window 34 can be encoded respectively as CLOSE(B) or ICONIZE(B,ICON,X,Y), wherein ICON refers to the minimized representation of the window on screen, and (X,Y) is its position. Scrolling of window 36 can be encoded as SCROLL(C,Y,BMP), wherein Y is the scrolling displacement (which may be positive or negative), and BMP points to a bitmap of height Y representing the content added to the top or bottom of the window at time $t_i$.

It will be understood that these are merely representative examples, and other possible types of transformations and schemes for representing such transformations will be apparent to those skilled in the art. What is important to note is the tremendous savings in data volume required to encode the contents of display 28 afforded by the present invention, by comparison with indiscriminate bitmap screen capture. In a bitmap representation of the entire display, a shift of window 32, for example, will require that substantially all of the pixels corresponding to the window be rewritten, at both the previous and current positions of the window, typically generating tens to hundreds of thousands of data bytes. The present invention enables the shift to be recorded using only a few bytes of data.

Preferably, the typical transformations recorded at step 64 also include transformations of cursor 56 and other on-screen icons. In the case of the cursor, the transformations include SHIFT and changes in the form on the corresponding icon (point left, point right, text cursor, etc.)

Application of the recorded typical transformations to the windows in the intermediate family FW1 will result in the generation of a transformed intermediate family FW2. At step 66, the residual transformations to the windows in FW2, which could not be encoded as typical transformations and which must be carried out in order to transform these windows into the corresponding members of $FW(t_i)$, are also encoded. Generally, although not necessarily, the preferred method for encoding a given window in $FW(t_i)$ is by encoding the changes in the content of the window relative to its counterpart in FW2, which reflects the result of typical transformations applied to the window content. Various methods are known in the art for such encoding, and it is an advantage of the present invention that different encoding methods and parameters may be applied to the different windows.

In one preferred embodiment of the present invention, the bitmaps of one or more of the windows in $FW(t_i)$ (or of all of the windows) are compared to their counterparts in FW2, and changes in the pixels are recorded, pixel by pixel. The resultant difference bitmap may be compressed, using any suitable method known in the art, such as run length encoding or LZW encoding. This type of encoding is particularly suitable for windows whose contents change relatively slowly, such as graphic window 32 or text window 36.

Alternatively or additionally, when the contents of a window change rapidly, as will be the case for video window 34, methods of video encoding are preferably applied, for example, MPEG and other compression algorithms known in the art. In a preferred embodiment, the MPEG or other video data are recorded separately from the contents of non-video windows. Most preferably, such video data are recorded in their original compressed data format and at the original frame rate of the video images that were generated by the application running in window 34, which may be different from the frame rate at which the other screen contents are captured.

In another preferred embodiment of the present invention, different encoding priorities are assigned to different windows in family 48, depending on their Z-order or on the applications running in the windows, for example. Thus, it is possible to encode changes to the bitmap contents of window 32, which is the top window in FIG. 2, in every recorded frame, while changes to bottom window 36 are encoded only once every few frames. Different compression schemes may also be applied to different windows, with lossy compression applied to low-priority windows. In an extreme case, such as a demanding motion video or graphic application, lower-priority frames may be frozen altogether. By the same token, the methods of the present invention may be applied in a straightforward manner to capture just a single window or a limited subset of the windows of interest, by recording only the contents and typical transformations applied to the window or windows of interest, while ignoring the remaining screen contents. Preferably, a user interface is provided on apparatus 20 to enable the user to select different screen capture parameters to be applied to different ones of the windows.

In still another preferred embodiment of the present invention, data are captured representing the contents of a given window or windows without reference to succeeding frames. This representation is useful particularly in data streaming applications.

Returning now to the windows in group 3, which were absent in $FW(t_{i-1})$, these windows are preferably captured and encoded ab initio, at an encode new windows step 68. (At the first frame, all of the windows in $FW(t_0)$ are in group 3.) Step 68 includes finding corners 50 of each new window, its bit value b, Z-order position and bitmap contents. The graph of the window family is updated to add these new windows.

The encoded typical and residual transformations, along with the new window information, are conveyed to an output data stream, at an output stream step 70. To the extent that the window contents include video data in a compressed video format, such as that shown in window 34, the compressed video is embedded in the output stream, preferably interleaved with the other screen capture data. In this case, the representation of the corresponding window in the screen capture data includes a pointer to the interleaved video stream. Audio data associated with window 34 or with another active window on display 28 can be interleaved in similar fashion. The output data stream can be stored to disk 30 or transferred immediately over link 38 for playback on apparatus 40. Meanwhile, apparatus 20 returns to step 60 to capture and encode the next frame.

The output data stream is read by a compatible screen player running on apparatus 40, as described further hereinbelow. Preferably, the data are formatted in a manner that is platform-independent, so that it will be possible to replay the screens even if apparatus 40 is running a different operating system from apparatus 20.

Figure 4:
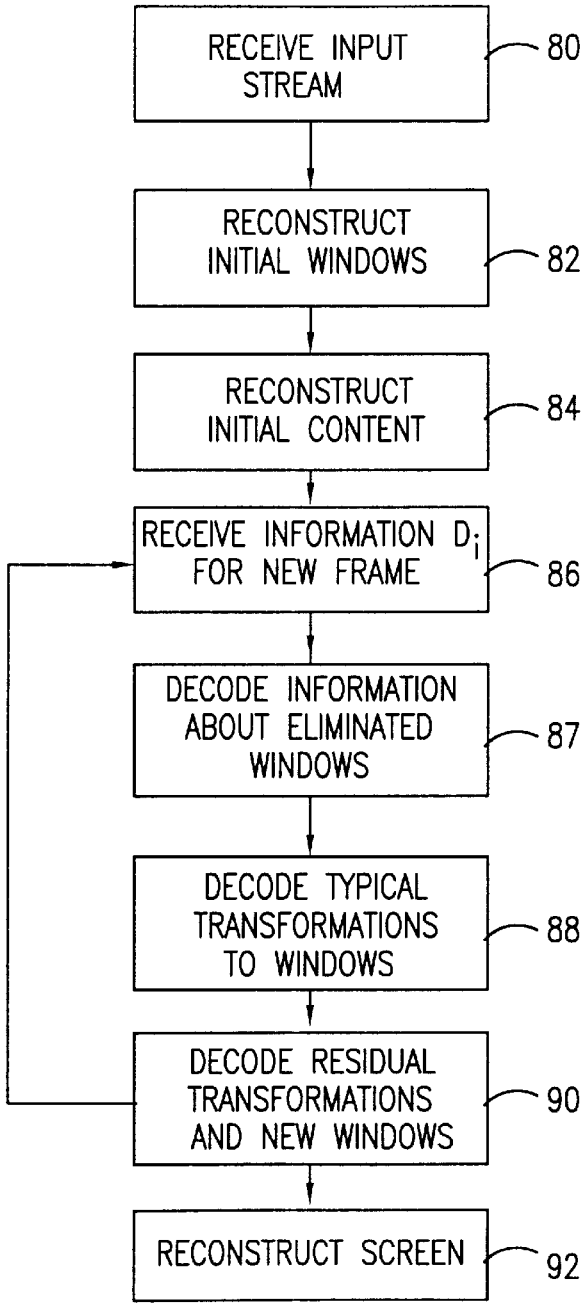
FIG. 4 is a flow chart, which schematically illustrates a method for replaying computer screens, in accordance with a preferred embodiment of the present invention.

FIG. 4 is a flow chart that schematically illustrates a method for reconstruction of screen images, in accordance with a preferred embodiment of the present invention. The data stream captured by apparatus 20 is received by apparatus 40 over link 38 at a receive input step 80. The stream may be conveyed to apparatus 40 for purposes of demonstration, training or education or, alternatively, apparatus 40 may be controlling the operation of processor 22 by remote control over link 38, as is known in the art, and receiving the screen images in this context. Further alternatively, the data stream may have been stored on disk 30 and later recalled from the disk by apparatus 20.

The data are received by a compatible screen player, most preferably a platform-independent Java player. The player first reads the data in the stream relating to the initial frame at time to, and uses the data to reconstruct an initial window family $FW(t_0)$, at an initial window reconstruction step 82. The player then reads and reconstructs the application-specific content that is displayed in each of the windows, at an initial content reconstruction step 84. To the extent that any of the windows, such as window 34, contain data encoded in a standard compressed media format, such as a video or audio format as described hereinabove, the screen player preferably invokes an appropriate standard media player, compatible with the compressed video or audio. For video data, the video player runs and displays the video in window 34 under the control of the screen player. Once the initial frame has been reconstructed, the screen player receives reconstruction information Di for each of the subsequent frames in succession at a receive information step 86. For each i=1, 2, . . . , N, $D_i$ includes information regarding the windows that existed in the preceding frame (at time $t_{i-1}$) but were eliminated in the current frame (at time $t_i$), along with the encoded typical transformations, the encoded residual transformations and the encoded new windows. At an eliminated windows decoding step 87, the identification of the eliminated windows is decoded. The typical transformations for each frame are decoded in a typical transformation decoding step 88. The residual transformations are similarly decoded, at a residual transformation decoding step 90. The decoded information is then used to reconstruct window family 48, in a screen reconstruction step 92.

Figure 5:
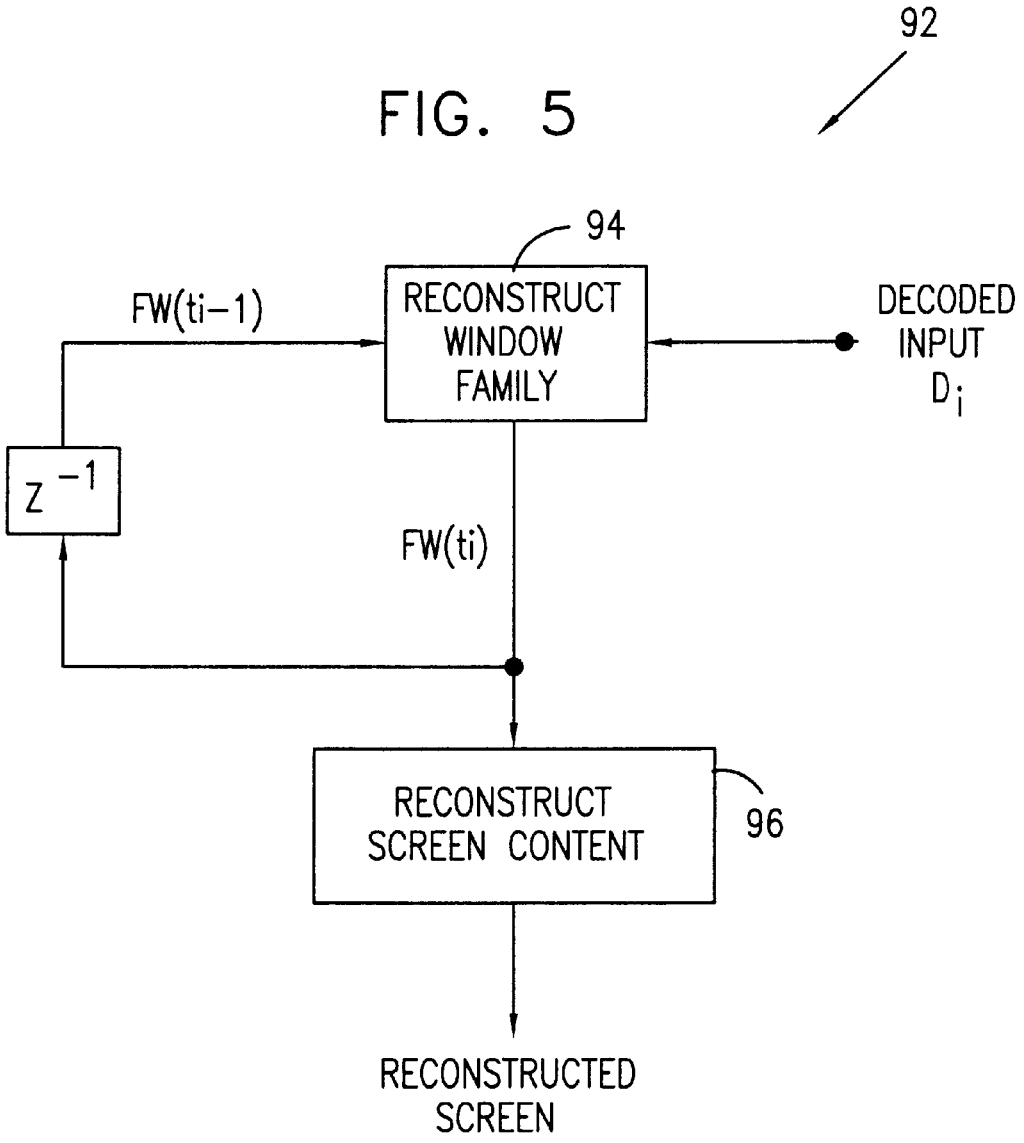
FIG. 5 is a flow chart, which schematically illustrates details of a method for screen image reconstruction, in accordance with a preferred embodiment of the present invention.

FIG. 5 is a flow chart that schematically illustrates a method of screen reconstruction used at step 92, in accordance with a preferred embodiment of the present invention. For each i=1, 2, . . . , N, the information $D_i$ is used to reconstruct the windows in $FW(t_i)$at a window family reconstruction step 94. The information regarding the windows that were in the preceding frame but are absent from the frame that is currently being reconstructed is used to construct the interim window family FW1 (consisting of the windows present at both times $t_{i-1}$, and $t_i$ with the window parameters at time $t_{i-1}$), which is included in the preceding family $FW(t_{i-1})$ The decoded typical transformations are applied to FW1 to generate the interim window family FW2, from which the new window family $FW(t_i)$ is derived. Following this step, the windows in $FW(t_i)$ are arranged in their proper position and relations for frame i, with the exception of any new window that may have been added in this frame.

The stored residual transformations, defining the contents of the windows in frame i relative to their content in frame i−1, are now applied to reconstruct the window contents. Finally, using the decoded information regarding any new windows in this frame, reconstruction of the window family $FW(t_i)$ is completed, preferably including the entire screen contents at time $t_i$.

The reconstructed windows are passed to a reconstruct screen content step 96, at which the reconstructed windows are assembled into a complete screen picture. Alternatively, steps 94 and 96 could proceed in parallel. As noted above, compressed video data are written into their appropriate window, as well. These steps are repeated in succession for each frame until the entire captured frame sequence has been played back.

It will be appreciated that the preferred embodiments described above are cited by way of example, and that the present invention is not limited to what has been particularly shown and described hereinabove. Rather, the scope of the present invention includes both combinations and subcombinations of the various features described hereinabove, as well as variations and modifications thereof which would occur to persons skilled in the art upon reading the foregoing description and which are not disclosed in the prior art.

What is claimed is:

1. A method for capture of computer screens in a sequence of frames, comprising:

identifying a first set of one or more windows appearing in a first frame in the sequence, each window in the set having respective first-frame window characteristics and window contents;

encoding a description of the first set of windows indicative of the appearance of the computer screen in the first frame;

identifying in a second frame in the sequence a second set of one or more windows having respective second-frame window characteristics and window contents, the second set including one or more windows corresponding respectively to one or more of the windows in the first set;

determining one or more transformations applied to the first-frame window characteristics of the windows in the first set to generate the second-frame window characteristics of the corresponding windows in the second set; and encoding a description of the second set of windows including the determined transformations, for use in reconstructing the computer screen as it appeared in the second frame, wherein identifying the first set of windows comprises identifying windows generated in accordance with an operating system of the computer, which associates each window with a respective function of the computer, such that the contents of the windows are determined by the respective functions.

2. A method according to claim 1, wherein the respective functions comprise applications running under the operating system.

3. A method according to claim 1, wherein determining the transformations comprises defining transformations applied by the operating system, and which are applicable to different windows associated with different functions, generally irrespectively of the functions.

4. A method according to claim 1, wherein identifying the second set of windows comprises querying the operating system regarding the characteristics of the windows.

5. A method according to claim 1, wherein identifying the second set of windows comprises intercepting events generated by the operating system.

6. A method according to claim 1, wherein identifying the first set of windows comprises processing an image of the screen to identify the windows.

7. A method according to claim 1, wherein determining the transformations comprises defining a set of typical transformations, which are applicable to alter the window characteristics of the one or more windows, generally irrespectively of the contents of the windows.

8. A method according to claim 7, wherein the typical transformations are selected from a group of transformations consisting of moving and resizing a window.

9. A method according to claim 7, wherein the typical transformations are selected from a group of transformations consisting of minimizing, restoring and maximizing the size of a window.

10. A method according to claim 7, wherein the typical transformations comprise changing a Z-order of the windows, according to which two or more of the windows are overlaid one upon another on the screen.

11. A method according to claim 7, wherein the typical transformations are selected from a group of transformations consisting of scrolling and panning the window contents.

12. A method according to claim 1, wherein identifying the first and second sets of windows comprises identifying windows associated with respective functions of the computer, wherein the identified windows include one or more user interface windows generated inside other identified windows for the purpose of controlling the functions associated therewith.

13. A method according to claim 1, and comprising identifying first and second sets of one or more icons in the first and second frames, respectively, and determining transformations applied to the icons in the first frame to generate the icons in the second frame, to be encoded along with the description of the second set of windows.

14. A method according to claim 13, wherein the first and second sets of icons comprise a cursor.

15. A method for capture of computer screens in a sequence of frames, comprising:

identifying a first set of one or more windows appearing in a first frame in the sequence, each window in the set having respective first-frame window characteristics and window contents;

encoding a description of the first set of windows indicative of the appearance of the computer screen in the first frame;

identifying in a second frame in the sequence a second set of one or more windows having respective second-frame window characteristics and window contents, the second set including one or more windows corresponding respectively to one or more of the windows in the first set;

determining one or more transformations applied to the first-frame window characteristics of the windows in the first set to generate the second-frame window characteristics of the corresponding windows in the second set; and encoding a description of the second set of windows including the determined transformations, for use in reconstructing the computer screen as it appeared in the second frame, wherein encoding the description of the first set of windows comprises encoding the first-frame window characteristics and the respective contents of the windows in the first set, and wherein encoding the description of the second set of windows comprises encoding the determined transformations and encoding changes in the contents of the windows in the second set with respect to the contents of the corresponding windows in the first set.

16. A method according to claim 15, wherein encoding the changes in the contents of the windows comprises applying different encoding schemes to the contents of different ones of the windows.

17. A method according to claim 16, wherein applying the different encoding schemes comprises applying a video compression scheme to the contents of at least one of the windows, and embedding resultant compressed video data in the encoded description of the windows.

18. A method according to claim 16, wherein applying the different encoding schemes comprises applying different levels of encoding resolution to different ones of the windows in the second set.

19. A method according to claim 15, wherein encoding the first and second descriptions comprises transferring the encoded descriptions over a communication link to a recipient computer.

20. A method according to claim 19, wherein encoding the descriptions comprises encoding the descriptions in a platform-independent format.

21. A method according to claim 15, wherein encoding the first and second descriptions comprises storing the encoded descriptions in a memory.

22. A method according to claim 15, and comprising reconstructing the second frame responsive to the encoded descriptions of the first and second sets of windows.

23. A method for reconstructing captured computer screens, comprising:

receiving an encoded description of a first set of one or more windows, having first-frame characteristics and window contents, which appeared on the computer screen in a first captured frame;

receiving an encoded description of a second set of one or more windows, having second-frame characteristics and window contents, which appeared on the computer screen in a second captured frame, subsequent to the first frame, the description of the second set of windows comprising a description of one or more transformations applied to the first-frame characteristics of at least one of the windows in the first set to derive the second-frame characteristics of a corresponding window in the second set; and reconstructing the second captured frame responsive to the encoded descriptions of the first and second sets of windows, wherein reconstructing the second captured frame comprises decoding the encoded description of the first set of windows to determine the first-frame characteristics thereof, and applying the one or more transformations described in the description of the second set of windows to transform the first-frame characteristics into the second-frame characteristics of the at least one corresponding window.

24. A method according to claim 23, wherein the encoded description of the second set of windows further comprises encoded changes in the contents of the windows in the second set with respect to the contents of the at least one corresponding window in the first set, and wherein reconstructing the second captured frame comprises reconstructing the contents of the windows in the second set responsive to the encoded changes.

25. A method according to claim 23, wherein the encoded description of the second set of windows comprises compressed video data in a standard media format, and wherein reconstructing the second captured frame comprises invoking a standard media player to reconstruct video images in one of the windows.

26. A method according to claim 23, wherein reconstructing the second captured frame comprises reconstructing the first and second sets of windows substantially independently of an operating system under which the windows were generated.

27. A method according to claim 26, wherein reconstructing the first and second sets of windows comprises operating a platform-independent screen player.

28. Apparatus for capture of computer screens in a sequence of frames, comprising:

a display; and a processor, which is adapted to identify a first set of one or more windows appearing on the display in a first frame in the sequence, each window in the set having respective first-frame window characteristics and window contents, and to encode a description of the first set of windows, indicative of the appearance of the computer screen in the first frame, and to identify, in a second frame in the sequence a second set of one or more windows appearing on the display, having respective second-frame window characteristics and window contents, the second set including one or more windows corresponding respectively to one or more of the windows in the first set, and to determine one or more transformations applied to the first-frame window characteristics of the windows in the first set to generate the second-frame window characteristics of the corresponding windows in the second set, and to encode a description of the second set of windows including the determined transformations, for use in reconstructing the computer screen as it appeared in the second frame, wherein the windows are generated in accordance with an operating system of the processor, which associates each window with a respective function of the processor, such that the contents of the windows are determined by the respective functions.

29. Apparatus according to claim 28, wherein the processor is further adapted to identify first and second sets of one or more icons in the first and second frames, respectively, and to determine transformations applied to the icons in the first frame to generate the icons in the second frame, to be encoded along with the description of the second set of windows.

30. Apparatus according to claim 28, wherein the processor is adapted to be coupled via a communication link to transfer the encoded descriptions to a recipient computer.

31. Apparatus according to claim 30, wherein the recipient computer reconstructs the second frame responsive to the encoded descriptions of the first and second sets of windows.

32. Apparatus according to claim 28, and comprising a memory adapted to store the encoded first and second descriptions.

33. A computer software product for capture of computer screens in a sequence of frames, the product comprising computer-readable media in which program instructions are stored, which instructions, when read by a computer, cause the computer:

to identify a first set of one or more windows appearing in a first frame in the sequence, each window in the set having respective first-frame window characteristics and window contents and to encode a description of the first set of windows, indicative of the appearance of the computer screen in the first frame, and to identify in a second frame in the sequence a second set of one or more windows having respective second-frame window characteristics and window contents, the second set including one or more windows corresponding respectively to one or more of the windows in the first set and to determine one or more transformations applied to the first-frame window characteristics of the windows in the first set to generate the second-frame window characteristics of the corresponding windows in the second set, and to encode a description of the second set of windows including the determined transformations, for use in reconstructing the computer screen as it appeared in the second frame, wherein the windows are generated in accordance with an operating system of the computer, which associates each window with a respective function of the computer, such that the contents of the windows are determined by the respective functions.

34. A product according to claim 33, wherein the determined transformations are applied by the operating system, and are applicable to different windows associated with different functions, generally irrespectively of the functions.

35. A product according to claim 33, wherein the program instructions, when run by the computer, cause the computer to query the operating system regarding the characteristics of the windows.

36. A product according to claim 33, wherein the program instructions, when run by the computer, further cause the computer to reconstruct the second frame responsive to the encoded descriptions of the first and second sets of windows.

* * * * *